United States Patent [19]

Spencer

[11] 4,442,738

[45] Apr. 17, 1984

[54] AUTOMATIC PUSH-TO-START SCREWDRIVER

[75] Inventor: Bob B. Spencer, Reno, Nev.

[73] Assignee: Standard Pneumatic Motor Co., a Division of Hamilton Company, Reno, Nev.

[21] Appl. No.: 362,982

[22] Filed: Mar. 29, 1982

[51] Int. Cl.[3] ..... B25B 23/14

[52] U.S. Cl. ..... 81/470; 81/57.37; 81/474; 173/12

[58] Field of Search ..... 81/467, 469, 470, 474, 81/57.37; 173/12; 221/312 A, 312 B, 312 C

[56] References Cited

U.S. PATENT DOCUMENTS

| | | | |
|---|---|---|---|
| 2,743,635 | 5/1956 | Shaff | 81/474 |
| 3,642,039 | 2/1972 | McGee | 81/470 |
| 3,686,983 | 8/1972 | Flagge | 81/470 |

*Primary Examiner*—James L. Jones, Jr.
*Attorney, Agent, or Firm*—Fitch, Even, Tabin & Flannery

[57] ABSTRACT

An automatic, push-to-start, fluid-operated screwdriver is disclosed including a magazine providing a supply of fasteners so that only a source of fluid pressure is required for operation. A control valve is responsive to push-to-start actuation for automatically initiating a series of steps including (a) commencing operation of a fluid operated motor, (b) terminating operation of the motor when a predetermined torque level is applied to the fastener, (c) causing a subsequent fastener to be released from the magazine, (d) relatively shifting a fastener holder and rotary drive means for allowing the subsequent fastener to enter into alignment with the rotary drive means, (e) causing the holder to secure the fastener in engagement with the rotary drive means, and (f) thereafter returning to the condition prior to step (a) so that the machine is automatically conditioned for driving the subsequent fastener upon push-to-start actuation. The control valve also causes pressurization of a fluid reservoir during operation of the motor. After termination of motor operation, air pressure from the reservoir shifts the holder and rotary drive means for allowing introduction of the subsequent fastener, the holder and rotary drive means thereafter being returned to secure the subsequent fastener in engagement with the rotary drive means. The screwdriver also includes a magazine mounting alternate threaded fasteners with their ends in opposing relation, a gate assembly releasing individual fasteners from the magazine in uniform alignment.

43 Claims, 18 Drawing Figures

FIGURE 15
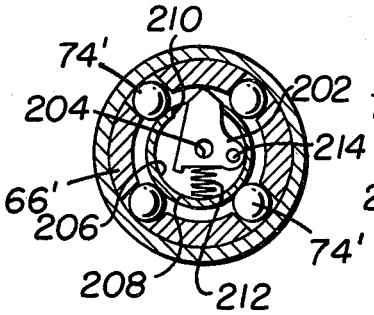
FIGURE 15A
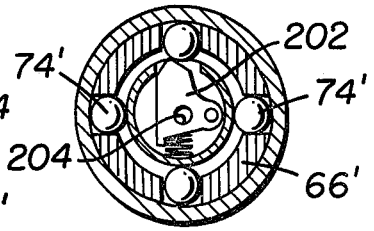
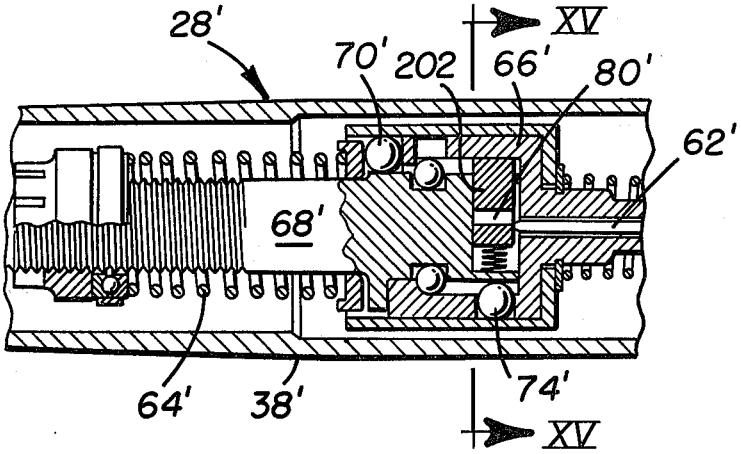
FIGURE 14

AUTOMATIC PUSH-TO-START SCREWDRIVER

BACKGROUND OF THE INVENTION

The present invention relates generally to a machine for automatically driving threaded fasteners such as screws into a suitable workpiece. More particularly, the invention relates to such a machine which is substantially self-contained and includes a replaceable magazine for supplying successive fasteners.

The prior art has provided a substantial number of automatic screwdrivers or machines which are power operated for driving threaded fasteners into engagement with a workpiece. With the screwdrivers or machines being fluid-operated, for example, by a source of air under pressure, threaded fasteners are commonly provided from a remote location through a delivery tube or the like to be received within the machine in engagement with a rotatable drive means or bit for driving the fastener into the workpiece.

The prior art has also provided a number of push-to-start automatic screwdrivers or similar machines for threaded fasteners wherein operation of a drive motor is actuated by the pressure of engagement between the threaded fastener and the workpiece.

More recently, the prior art has also provided fastener machines including self-contained magazines or cartridges for supplying screws or fasteners into engagement with a rotary drive means. Usually, these machines are manually actuated by a trigger or the like in order to commence rotation of the fastener for engaging it with the workpiece.

As is apparent from the preceding description, fastener machines of the type referred to herein are most commonly used with threaded fasteners in the form of screws. A workpiece may for example be formed with a tapped or untapped opening for receiving the threaded fastener. However, it is also contemplated by the invention that the machine could be of a self-tapping type wherein the threaded fastener forms an opening in the workpiece for receiving the threaded fastener.

The invention contemplates such machines for driving other types of threaded fasteners besides screws into engagement with a workpiece. For example, the threaded fastener could be in the form of a bolt or even a threaded nut, the workpiece then being in the form of a threaded shank for receiving the nut. In any event, the invention is to be generally construed in terms for applying any of a variety of threaded fasteners to a suitable workpiece.

In connection with the engagement of such a variety of threaded fasteners to suitable workpieces, it is desirable in many applications to provide a machine suitable for driving fasteners in rapid succession. Accordingly, there has been found to remain a need for an automatic machine for applying threaded fasteners or the like which is capable of overcoming various limitations of the prior art as summarized above.

SUMMARY OF THE INVENTION

It is therefore an object of the invention to provide a push-to-start machine adapted for automatically applying threaded fasteners to a workpiece in response to engagement pressure between the threaded fastener and the workpiece, the machine including a magazine mountable thereon for providing a supply of fasteners and control means operatively coupled with various portions of the machine while including means for functioning automatically in response to push-to-start engagement of the fastener with the workpiece for (a) initiating operation of motor means for driving the fastener, (b) terminating operation of the motor when a predetermined torque is applied to the fastener, (c) causing a subsequent fastener to be released from the magazine, (d) shifting a fastener holder and rotary drive means in the machine for allowing the subsequent fastener to enter into alignment with the rotary drive means, (e) allowing the holder and rotary drive means to return to a position with the holder securing the fastener in engagement with the rotary drive means, and (f) thereafter returning to a condition prior to step (a) whereby the machine is automatically conditioned for driving the subsequent fastener upon push-to-start actuation thereof.

Preferably, the machine is pneumatically powered with the control means comprising a valve unit for carrying out the steps set forth above.

It is also an object of the invention to provide a control means for a powered machine for driving fasteners, a fluid reservoir being filled with fluid under pressure during operation of the motor, fluid under pressure from the reservoir serving to shift the holder and rotary drive means relative to each other for allowing the subsequent fastener to enter into alignment with the rotary drive means. It is further contemplated that fluid pressure be allowed to thereafter escape, preferably through suitable leakage means, in order to return the holder and rotary drive means to a position with the holder securing the fastener in engagement with the rotary drive means.

Within the combination referred to above, the invention also contemplates delay means for assuring that a successive fastener is in place to be received between the holder and rotary drive means when the holder and rotary drive means are shifted for receiving the fastener therebetween. Preferably, this delay function is also accomplished by the fluid valve referred to above.

It is another object of the invention to provide a powered machine of a type adapted for driving fasteners having a fitted shank at one end and an enlarged head at the other end into a suitable workpiece, the invention providing an improvement in such a machine in the form of a magazine mountable thereupon for providing a supply of fasteners, the fasteners being contained within a chamber of the magazine with their threaded shanks parallel to each other and the heads of adjacent fasteners opposite each other, the machine including gate means for sequentially releasing the fasteners from the magazine and suitable chute means for arranging the successive fasteners in proper alignment with a holder and rotary drive means of the machine.

It is a related object of the invention to provide a suitable magazine for such a machine, the magazine being configured as referred to above for containing the successively opposed fasteners. In accordance with this object, it is particularly contemplated that the cartridge be formed with a housing forming an elongated chamber including a central channel for containing the threaded shanks of the fasteners, in large channels being formed at either side of the central channel for each containing the heads of alternate successive fasteners. The housing of the magazine also preferably includes an opening at one end of the elongated chamber for allowing the oppositely arranged fasteners to pass successively from the chamber and into a suitable receiving means when the magazine is mounted on the fastener driving machine.

It is yet another object to provide an improved torque-responsive clutch for terminating operation of a drive motor through an axially movable rod, a member being pivoted by overriding operation of the clutch for shifting the rod and terminating motor operation. Two embodiments of the improved clutch are described below and are each adapted to automatically reset during each operating cycle.

Additional objects and advantages of the invention are made apparent in the following description having reference to the accompanying drawings.

BRIEF DESCRIPTION OF THE DRAWINGS

FIG. 14 is a fragmentary axially sectioned view of another embodiment of a torque responsive clutch.

FIG. 15 is a view taken along section line XV of FIG. 1 with the clutch in an operating condition.

FIG. 15A is a view similar to that of FIG. 15 with the clutch in an intermittent overriding condition.

DESCRIPTION OF THE PREFERRED EMBODIMENT

Figure 1:
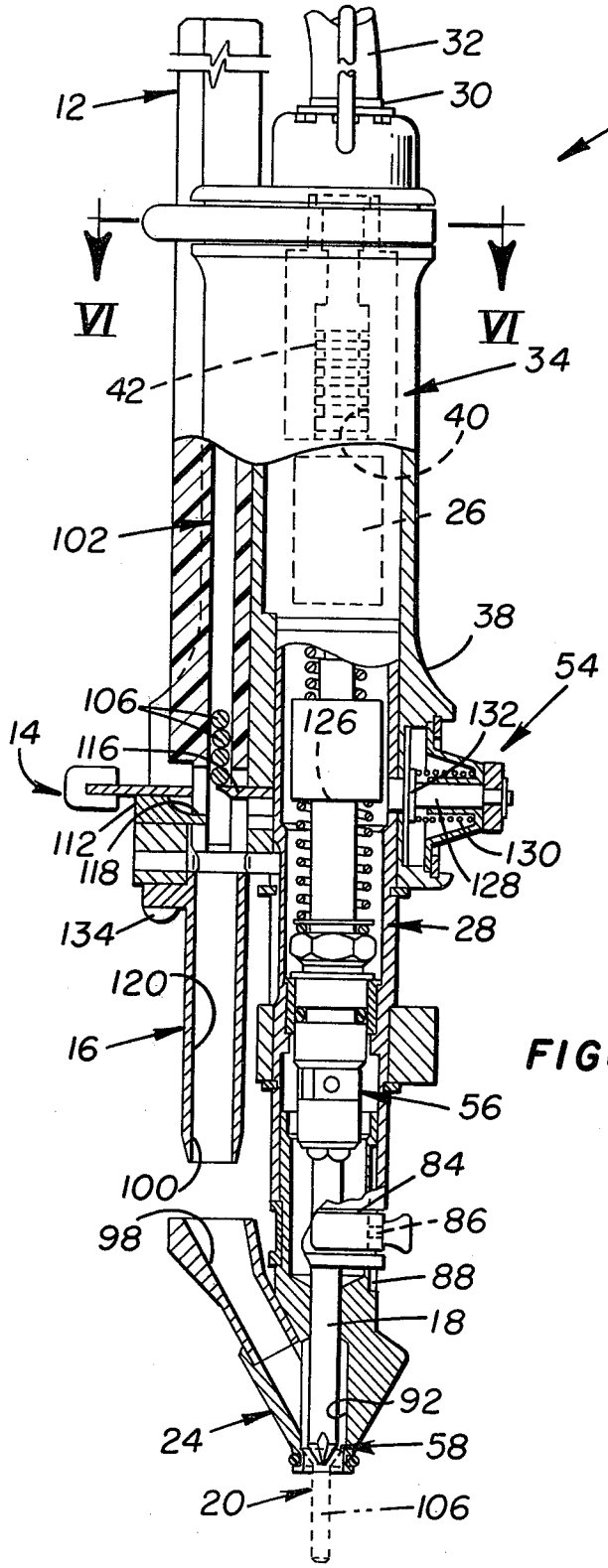
FIG. 1 is a side view in elevation, with parts in section, of the automatic screwdriver of the present invention.

Referring now to the drawings and particularly to FIG. 1, an automatic fastening machine is indicated at 10, preferably in the form of a screwdriver, including a magazine 12 for providing a supply of successive fasteners to the machine. The magazine is replaceable in order to permit mounting of a new magazine upon the machine when the first magazine is exhausted. The machine includes a gate assembly 14 for releasing individual fasteners from the magazine at predetermined times in accordance with the following description. The fasteners released from the magazine through the gate assembly 14 pass through a chute or funnel 16 which is adapted to assure proper alignment of the fasteners for passage into the machine. The machine itself includes a rotary drive means or bit 18 designed for engagement with each fastener 20 in order to drive it into engagement with a suitable workpiece 22 (also see FIGS. 7–10).

Each successive fastener 22 is maintained in engagement with the rotary drive means 18 by a fastener holder 24. The fastener holder 24 and rotary drive means 18 are movable relative to each other between a first position where the rotary drive means and holder are shifted apart in order to permit a fastener to enter into alignment with the rotary drive means and a second or return position where the holder secures the fastener in engagement with the rotary drive means. The rotary drive means 18 is coupled for rotation with a fluid or air-operated motor 26 through a torque responsive clutch 28 described in greater detail below.

An inlet 30 is adapted for connection with a pneumatic or air hose 32 providing a source of fluid or air under pressure from a pump or the like (not shown) for communication to the air motor 26 and other components of the machine 10 as determined by a control valve 34. As will be described in greater detail below, the control valve 34 serves to initiate and regulate a number of operating steps for the machine or screwdriver 10 in order to make it entirely automatic. Initially, the control valve 34 serves to regulate the passage of fluid or air under pressure to the motor 26 as described above. The control valve also regulates operation of the gate assembly 14 in order to successively release individual fasteners from the magazine 12 as necessary for operation of the screwdriver 10. In addition, the control valve functions to pressurize a reservoir 36 (see FIG. 6) during operation of the air motor 26. Operation of the air motor is terminated through the control valve 34 by means of the torque responsive clutch 28 in a manner described in greater detail below when each fastener is secured to the workpiece at a predetermined torque level. At that time, the control valve 34 serves to communicate fluid or air under pressure from the reservoir 36 in order to relatively shift the rotary drive means 18 and holder 24 for allowing a subsequent fastener to enter into alignment with the rotary drive means. Thereafter, the control valve 34 or a portion thereof as described below, permits the combination of the rotary drive means 18 and holder 24 to return to their initial condition with the holder 24 securing the subsequent fastener in engagement with the rotary drive means. Finally, the control valve 34 returns itself and the machine or screwdriver 10 to an initial condition for initiating engagement of the subsequent fastener with its workpiece upon push-to-start actuation.

In accordance with operation of the control valve 34 as summarized above, the machine or screwdriver 10 is preferably contemplated as being adapted for push-to-start operation when each fastener 20 is urged into engagment under pressure with the workpiece 22. In view of the function provided by the control valve 34, it is thus only necessary for an operator to move the machine or screwdriver 10 and fastener 20 toward the workpiece 22 in order to initiate the entire operating cycle for the machine.

Figure 2:
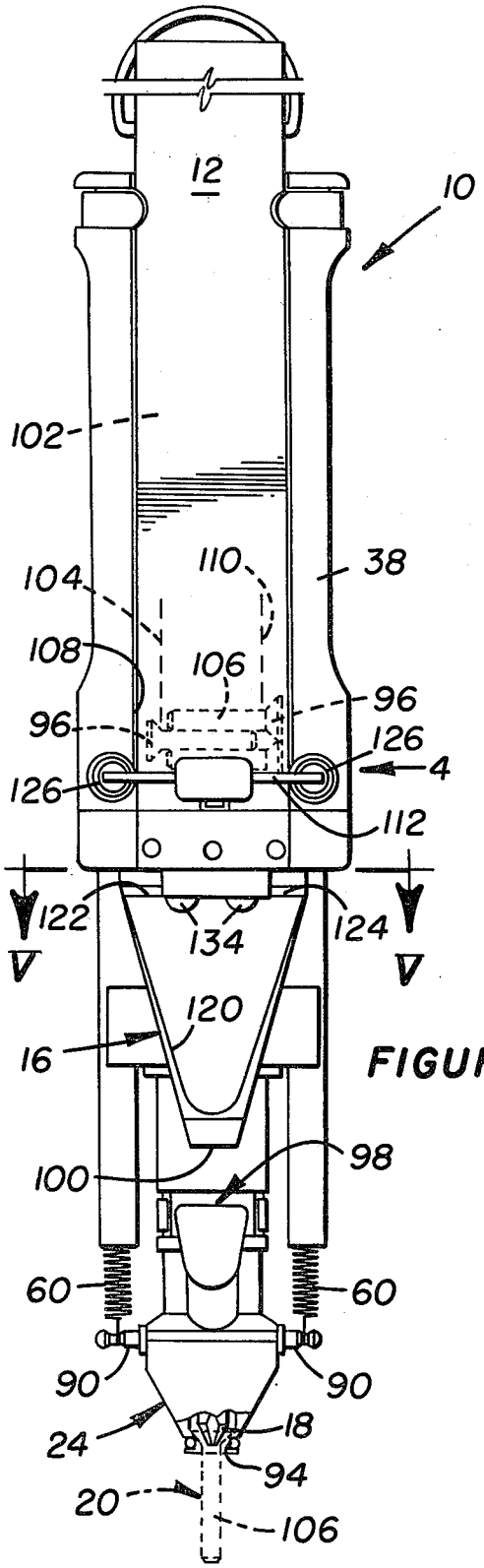
FIG. 2 is a view of the automatic screwdriver taken from the left side of FIG. 1.

It may be further seen with reference particularly to FIGS. 1 and 2 that the machine 10 is provided with a generally cylindrical housing 38 providing a grip for the operator. Such a configuration is particularly contemplated for use in assembly line or bench operations where the workpiece is in the form of a horizontal surface and the machine or screwdriver 10 remains in a generally vertical position during its entire operating cycle. In this configuration, it is contemplated that the fasteners may be transferred by gravity when they are released from the magazine by the gate assembly 14 for passage to the holder 24.

However, the invention also contemplates formation of the machine or screwdriver 10, for example, in a conventional pistol grip type configuration particularly for use in applications where the workpiece is to be arranged vertically and the machine or screwdriver 10 is to remain generally horizontal during its operating cycle. In such a modified condition, it might still be possible to provide for passage of the fasteners from the magazine to the holder under the influence of gravity. However, it may also be contemplated that a mechanical or pneumatic assist be provided for transferring each successive fastener from the magazine and gate assembly to the holder.

Before continuing with a detailed description of the machine or screwdriver 10, other basic features of the invention are summarized below.

Initially, with the control unit 34 being in the form of a valve for regulating the flow of fluid or air under pressure to various components of the screwdriver 10, the reservoir 36 serves the important function of relatively shifting the rotary drive means 18 and holder 24 to allow a successive fastener to enter into alignment with the drive means after operation of the motor 26 is terminated, preferably after the rotary drive means 18 is removed from the fastener 20 engaged with the workpiece 22. The control valve 34, or a remote portion of the pneumatic circuit in communication therewith, includes leakage means described in greater detail below for allowing air pressure from the reservoir to be exhausted so that the rotary drive means 18 and holder 24 may return to their initial condition with the holder 24 securing a subsequent fastener in engagement with the rotary drive means 18. This feature of the invention may of course be employed in fastener driving machines other than the particular push-to-start type particularly described herein.

The combination of the gate assembly 14 and the chute or funnel 16 together with the removable magazine 12 may also be employed in a variety of fastener driving machines other than the particular configuration described herein. In this regard, and as is described in greater detail below, the magazine 12 is preferably adapted for securing a succession of fasteners with adjacent fasteners being arranged in opposing relation in order to permit the storing of an increased number of fasteners within each magazine. The gate assembly 14 allows these opposing fasteners to pass from the magazine while the chute of funnel 16 assures proper alignment of the successive fasteners as they pass toward the holder 24.

Finally, the replaceable magazine 12 may also be employed with a variety of fastener driving machines in addition to that particularly described herein.

Figure 6:
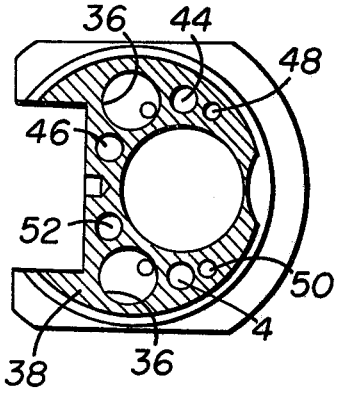
FIG. 6 is a view taken along section line VI—VI of FIG. 1 in order to better illustrate a valve housing formed within the screwdriver for controlling various steps of its operation.

To describe the machine or screwdriver 10 in greater detail, fluid or air under pressure from the inlet 30 is communicated into a valve housing 40 having an axially movable spool 42 formed with lands and recesses for regulating passage of air under pressure to various components of the screwdriver 10. As is illustrated in FIG. 6, a plurality of axial passages 44, 46, 48, 50 and 52 communicate fluid under pressure from the control valve to various components of the screwdriver 10.

Since the construction of the valve housing 40 and spool 42 are generally conventional in themselves, the axial passages are described below with reference to FIGS. 7–10. With the spool 42 being in the position illustrated in FIG. 7, air under pressure from the inlet 30 is blocked from entering into the valve housing 40.

Figure 8:
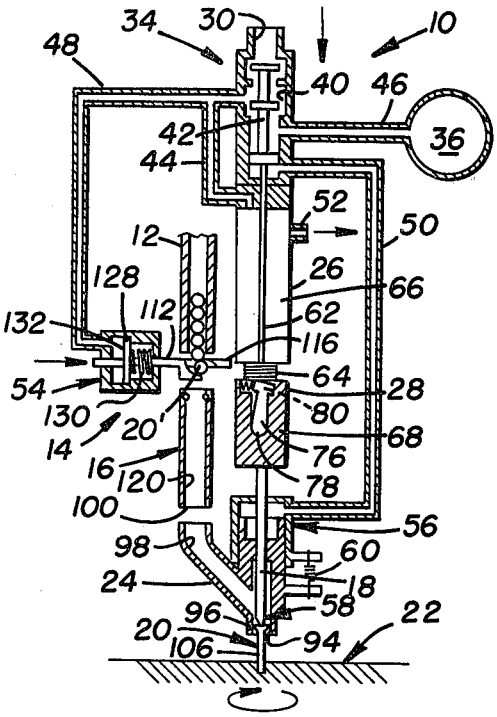
FIG. 8 is a schematic representation similar to that of FIG. 7 while illustrating components of the screwdriver in a slightly shifted condition relative to FIG. 7 to represent push-to-start actuation of the screwdriver.

As the spool 42 shifts upwardly to the position of FIG. 8, air under pressure from the inlet 30 is allowed to flow through the first axial passage 44 which is in communication with the air motor 26. At the same time, air under pressure also flows through the second axial passage 46 which is in communication with the reservoir 36 (also see FIG. 6). Also simultaneously as air under pressure is communicated to the motor 26 and the reservoir 36, it is also communicated through the third passage 48 to a piston unit 54 forming part of the gate assembly 14.

Initial pressurization of the piston unit 54 causes the gate assembly 14 to release a single subsequent fastener 20′ from the magazine. However, as is described in greater detail below, the subsequent fastener 20′ is captured by the gate assembly 14 until later in the operating cycle of the screwdriver when it is allowed to pass toward the holder 24.

It is particularly noted that certain of the operating steps of the invention could be performed in various manners in response to the control unit 34. For example, the gate assembly 14 could operate to release a single fastener whenever the holder 24 returns to its normal position relative to the rotary drive means 18.

Figure 7:
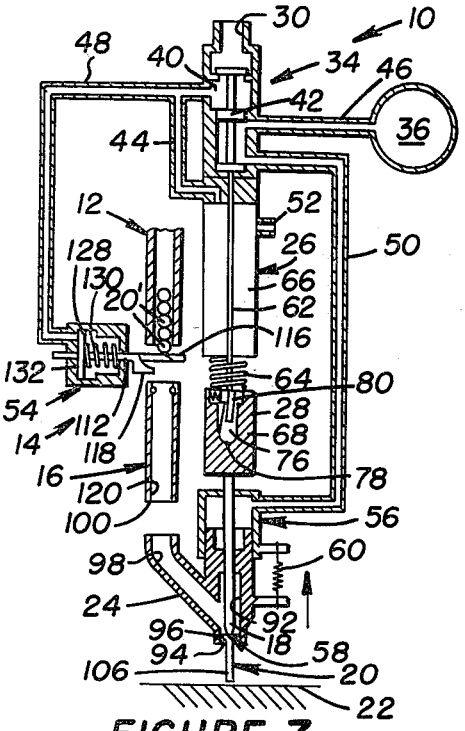
FIG. 7 is a schematic representation of the automatic screwdriver with various components illustrated in a condition prior to operation with a threaded fastener being secured between a holder and rotary drive means of the screwdriver for engagement with a workpiece.

Returning again to the control valve 34, when the spool 42 initially returns to the position also illustrated in FIG. 7, the flow of air under pressure is simultaneously cut off from the motor 26, the reservoir 36 and the piston unit 54 of the gate assembly 14. The gate assembly immediately responds by returning to its initial position so that the subsequent fastener 20′ is allowed to drop toward the holder 24.

At the same time, fluid under pressure in the reservoir 36 is placed in communication with another piston unit 56 associated with the combination of the rotary drive means 18 and holder 24 by means of the fourth passage 50. However, the control valve 34, the passage 50 and/or the piston unit 56 are configured or sized to cause a delay so that the piston unit 56 does not respond to pressure from the reservoir 36 until ample time has been allowed for the subsequent fastener 20' to pass from the gate assembly 14 toward and into the holder 24. After that delay period, which may commonly be a fraction of a second, the piston unit 56 responds to air pressure from the reservoir 36 by shifting the rotary drive means 18 and holder 24 relatively apart from each other into their positions illustrated in FIG. 10 so that the subsequent fastener 20' may drop into alignment with the lower end 58 of the rotary drive means 18.

Figure 10:
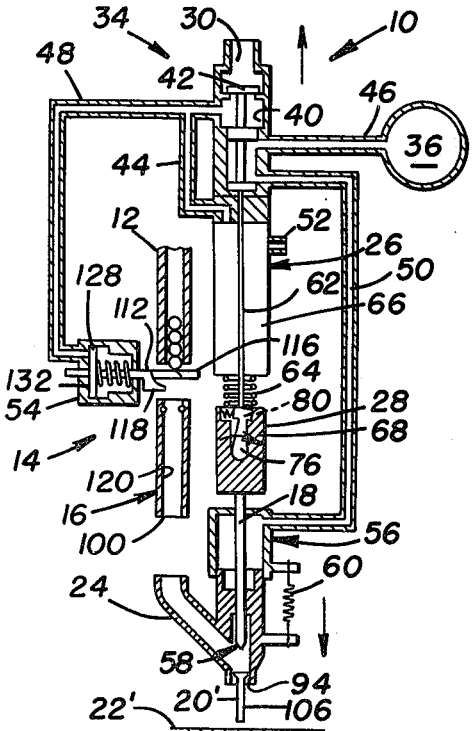
FIG. 10 is a final schematic representation of the automatic screwdriver similar to FIGS. 7–9 with its holder and rotary drive means being shifted relative to each other for receiving a subsequent fastener in alignment with the rotary drive means, the automatic screwdriver of FIG. 10 thereafter being automatically returnable to the condition illustrated in FIG. 7 for initiating engagement of the subsequent fastener with a suitable workpiece.
Figure 13A:
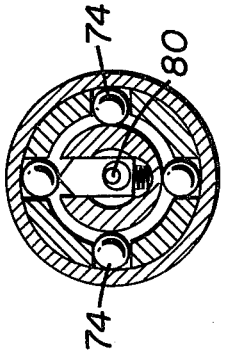
FIG. 13A is similarly a view taken along section line XIII—XIII of FIG. 11 with the clutch being in the same intermittent position referred to above in connection with FIG. 12A.
Figure 13:
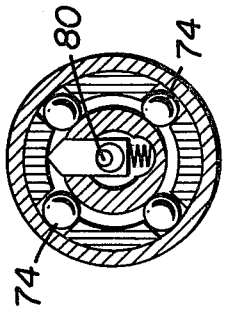
FIG. 13 is a view taken along section line XIII—XIII of FIG. 11 with the clutch being in the same operating position described above with reference to FIG. 12.

As may be seen in FIG. 10, the holder 24 is adapted to shift downwardly on the screwdriver 10 in order to move away from the relatively fixed rotary drive means or bit 18. However, it will be apparent that the screwdriver or machine 10 could also be designed with the rotary drive means 18 being retractable from the holder 24 in order to accomplish the same function.

In any event, pressurization of the piston unit 56 is terminated preferably by fluid leakage either from the control valve 34 or from the piston unit 56 itself in order to allow the holder 24 to subsequently return to the initial position illustrated in FIG. 7. In the present embodiment, the holder is returned to its initial position by the spring 60. Thus, the control unit 34 serves to reassume its initial condition with all other portions of the machine or screwdriver 10 also being returned to their initial conditions as illustrated in FIG. 7 so that the screwdriver 10 is automatically ready to commence a new operating cycle when the subsequent fastener 20' is urged into engagement with its workpiece.

The final axial passage 52 provides a vent for allowing spent air to escape from the air motor 26.

Figure 9:
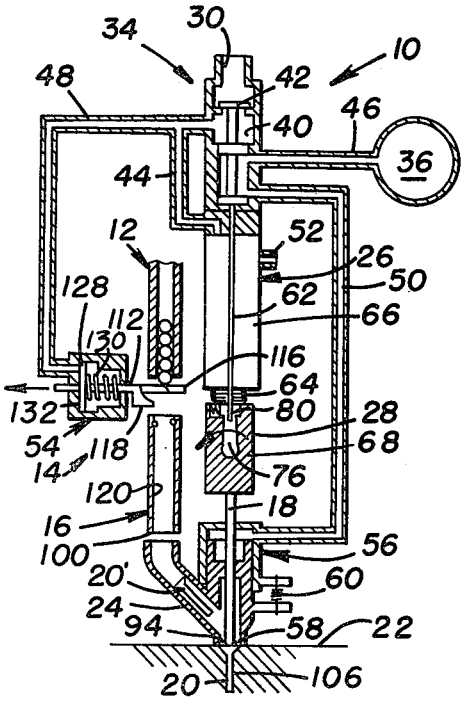
FIG. 9 is yet another schematic representation of the automatic screwdriver illustrating a condition where the threaded fastener has been driven into engagement with the workpiece to a predetermined torque setting at which operation of the fastener by the screwdriver is to be terminated.

The actual position of the spool 42 is regulated by a pin 62 which extends axially downwardly through the air motor 26 for engagement with a portion of the torque sensitive clutch 28 as described in greater detail below. The valve spool 42 and the pin 62 are initially shifted upwardly from the position in FIG. 7 into the position of FIG. 8 as the fastener 20 is urged into engagement with the workpiece 22. The pressure of engagement between the fastener and the workpiece causes the rotary drive means or bit 18 and the clutch 28 to shift upwardly within the screwdriver housing 38 against a spring 64. The valve spool 42 and pin 62 are thus held in their upwardly shifted positions until the fastner 20 is engaged with the workpiece 22 at the predetermined torque level. At that time, the torque sensitive clutch functions in a manner described in greater detail below to allow the pin 62 to shift downwardly into its initial position, the spool 42 then also returning to its initial position as illustrated in FIGS. 7 and 9. The rotary drive means or bit 18 and clutch 28 remain shifted upwardly against the spring 64 until the screwdriver is lifted off of the workpiece 22 whereupon the spring 64 again urges the clutch and the bit 18 downwardly. At that time, the torque sensitive clutch again resumes its initial operating condition as illustrated in FIG. 10 while delayed airflow from the reservoir 36 is causing separation between the holder 24 and the bit 18.

The air motor 26 is of generally conventional construction in itself. Accordingly, its details of construction are not described in greater detail herein.

Figure 12A:
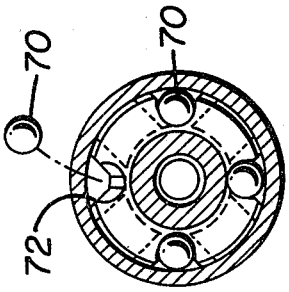
FIG. 12A is a view similar to that of FIG. 12 but illustrating the clutch in an intermittent position with the predetermined level of torque being applied to the fastener.
Figure 12:
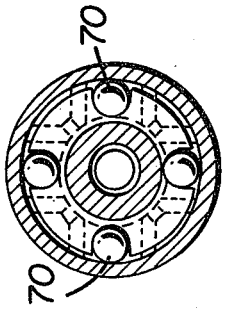
FIG. 12 is a view taken along section line XII—XII of FIG. 11 with the clutch being in an operating condition for transmission of torque from the motor means of the screwdriver to the rotary drive means.

The torque responsive clutch is illustrated in greater detail in FIGS. 11, 12, 12A, 13 and 13A, reference to which is also made hereinbelow. Within the clutch, a driving member 66 coupled with the air motor 26 engages a driven member 68 by means of a plurality of ball bearings 70 as also illustrated in FIGS. 12 and 12A. The driving member 66 forms a ramp 72 adjacent each of the ball bearings 70. The angle of the ramps 72 is selected so that the ball bearings 70 resist riding up on the ramps until a predetermined torque is applied to the fastener 20 by the screwdriver. At that time, one of the ball bearings 70 rides up on the ramp to permit relative rotation between the driving member 66 and the driven member 68.

Simultaneously, one of a plurality of detent balls 74 engages a lever 76 which is pivotally connected to the driven member 68 at 78. Interaction between the detent ball 74 and the lever 76 causes the lever 76 to pivot relative to the axis of the driven member 68 so that a small hole or opening 80 is placed in alignment with the lower end of the pin 62. Thus, as the lever 76 is pivoted by one of the detent balls 74, it allows the pin 62 to return downwardly to its initial position with the valve spool 42 also being returned to the initial position of FIGS. 7, 9 and 10. As noted above, once the screwdriver is released from the workpiece 22, the spring 64 causes the driven member 68 to be shifted downwardly relative to the driving member 66. At that time, the lever 76 is again pivoted to its initial position with its hole 80 out of alignment with the pin 62 under the influence of a spring 82. Thus, when the screwdriver is lifted off of the workpiece 22 as indicated in FIG. 10, the clutch is again returned to its initial operating position ready to commence a new operating cycle.

The rotary drive means or bit 18 is releasably secured for rotation with the clutch 28 to permit replacement of the bit 18, for example, if the screwdriver is to be used with screws or fasteners of different sizes.

Referring particularly to FIG. 1, the holder 24 is secured to the housing 38 by a resilient C-clamp 84. The C-clamp 84 is sized to slip onto the lower end of the housing 38 with an internal pin 86 entering into a channel 88 of the holder to secure it in place. Referring also to FIG. 2, the spring 60 may be disconnected from lugs 90 on the holder, the C-clamp 84 then being removable in order to permit rapid replacement of the holder upon the screwdriver housing 38.

The fastener holder 24 is internally formed with an axial chamber 92 extending parallel to the lower end of the bit 18. At the lower end of the chamber 92, a resilient O-ring 94 is mounted on the holder to normally prevent the fastener 20 from slipping downwardly out of the holder. As may be best seen in FIG. 2, with the holder and bit shifted toward each other, the flexible O-ring 94 urges the fastener 20 into engagement with the bit 18. However, as the fastener 20 is threaded into the workpiece, its enlarged head 96 is allowed to pass through the flexible O-ring and into engagement with the workpiece.

The holder also forms an inlet chamber 98 which angles away from the axial chamber 92 toward an outlet 100 of the chute or funnel 16. Thus, a fastener or screw passing downwardly through the funnel 16 may be received in the inlet chamber 98 for passage into the axial chamber 92 in alignment with the bit 18 when the holder 24 is shifted downwardly to the position illustrated in FIG. 10.

The magazine 12 which is replaceably mounted upon the housing 38 of the screwdriver 10 is formed with an elongated chamber 102 including a central passage 104 having a width suitable for receiving the diameter of the threaded shanks of a plurality of the fasteners or screws 20. The shanks of the screws are indicated at 106 in FIG. 1. As may be best seen in FIG. 2, enlarged passages 108 and 110 are formed on opposite sides of the central passage 104 to receive the enlarged heads 96 of the screws 20. As may also be seen in FIG. 2, the adjacent screws 20 are arranged with their heads in opposing relation so that a greater number of screws may be placed in each magazine.

Figure 3:
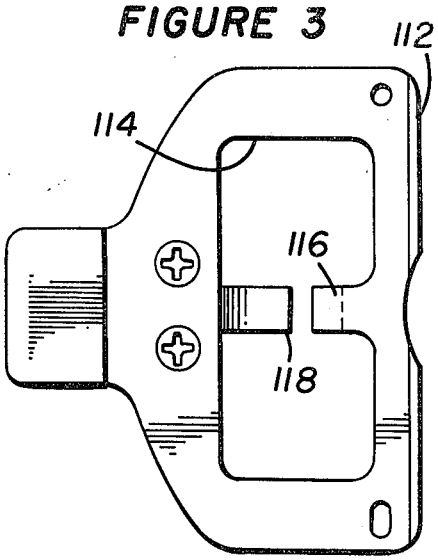
FIG. 3 is a fragmentary, detailed view of a tripper plate functioning in combination with a magazine mountable on the automatic screwdriver of FIG. 1.
Figure 4:
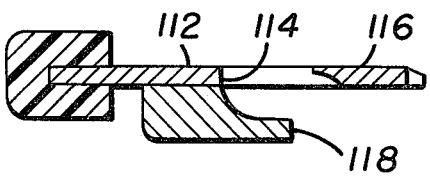
FIG. 4 is a side view of the tripper plate of FIG. 3.

Referring particularly to FIG. 1, the gate assembly 14 includes a tripper plate 112 which is illustrated in greater detail in FIGS. 3 and 4. The tripper plate 112 is formed with a central opening 114 so that when the tripper plate is mounted on the housing 38, the opening 114 is in alignment with the elongated chamber 102 of the magazine. A retainer bar normally extends across the end of the elongated chamber of the magazine in order to prevent the screws from dropping out of the magazine. When the gate assembly 14 is initially shifted to the position of FIG. 8, the tripper plate is moved leftwardly so that the retainer bar 116 is retracted away from the elongated chamber 102 of the magazine. The screws 20 may then drop downwardly from the magazine until one of the screws engages the capture bar 118. As the tripper plate 112 is again shifted leftwardly into the position of FIG. 9, the single screw supported by the capture bar 118 is allowed to pass downwardly into the chute of funnel 16 while the remainder of the screws in the magazine are prevented from exiting the magazine by the return of the retainer bar 116 to its initial position.

Figure 5:
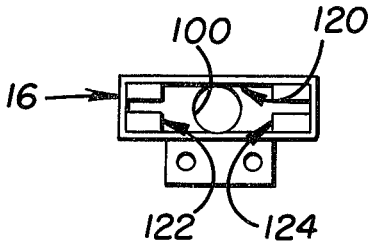
FIG. 5 is a view taken along section line V—V of FIG. 2.

With the screws being arranged in opposed relation as described above, the chute or funnel 16 is designed to assure that they pass in uniform alignment for reception by the holder 24. Referring particularly to FIG. 5, the funnel 16 is formed with a tapered internal opening 120 extending downwardly toward the outlet 100. The upper end of the funnel 16 is formed with split ledges 122 and 124 on opposite sides. The split ledges 122 and 124 are adapted to initially catch the heads of the screws depending on their opposed orientation in the magazine 12. Thus, the screws are caused to pass shank first through the funnel and into the inlet chamber 98 of the holder.

The tripper plate 112 is connected by means of a yoke assembly 126 (see FIG. 2) with a piston 128. The piston 128 is normally urged leftwardly as viewed in FIG. 1 by a spring 130 while air pressure from the passage 48 (also see FIGS. 7–10) is applied to the face 132 in order to shift the piston 128 rightwardly and to move the tripper plate 116 rightwardly into the position of FIG. 8.

Before describing the method of operation for the screwdriver 10, it is noted that the machine or screwdriver 10 is adapted to accommodate fasteners of different sizes. With the machine 10 being a screwdriver, it is particularly contemplated that it accommodate screws of different diameters and lengths. For this reason, a number of components on the screwdriver are readily replaceable in order to accommodate the screws of different sizes. Initially, the magazine is of course replaceable and different sizes of magazines would be required for screws of different diamaters and lengths. At the same time, it is contemplated that the holder 24 and tripper plate 112 be replaceable for screws of different diameters. For screws of different lengths, it is necessary to change the chute or funnel 16. The manner of replacing the holder was described above. The tripper plate 112 may be readily disconnected from the yoke assembly 126 for replacement. Similarly, the chute or funnel 16 is secured to the housing 38 by screws 134 which permit its replacement. As was noted above, it may also be necessary under certain circumstances to change the rotary drive means or bit 18. However, it is to be noted that a conventional bit would be usable with any of a variety of screws or threaded fasteners.

The method of operation is believed clearly apparent from the preceding description and is again noted that portions of the operating cycle were described above in order to more clearly describe various components of the screwdriver 10. However, the method of operation for the screwdriver is summarized below in order to assure a complete understanding of the invention.

The method of operation for the machine or screwdriver 10 is described below primarily with reference to FIGS. 7–10. Initially, a threaded fastener 20 is arranged in the holder 24 so that the resilient O-ring 94 maintains it securely in engagement with the lower end of the bit 18. The machine or screw driver 10 is then in the condition illustrated in FIG. 7. Air pressure is cut off from the motor 26 by the valve 34 with fluid or air pressure also being exhausted from the reservoir 36.

The operator then need only urge the screwdriver downwardly to engage the fastener 20 with the workpiece 22. Engagement pressure of the fastener on the workpiece causes the bit 18 and the clutch 28 to shift upwardly so that the pin 62 shifts the valve spool 42 upwardly to the position of FIG. 8. As the spool 42 shifts upwardly, air pressure from the inlet 30 is simultaneously admitted to the air motor 26, the piston unit 54 for the gate assembly 14 and the reservoir 36. The motor 26 is then driven in rotation so that torque is applied through the clutch 28 and bit 18 to commence driving the screw 20 into the workpiece 22. At the same time, the tripper plate 112 is shifted rightwardly by the piston unit 54 so that a single screw 20′ passes downwardly to engage the capture bar 118.

The passage 46 is sized so that the reservoir 36 is fully pressurized before the fastener 20 is driven securely into the workpiece 22.

As the screw 20 is driven securely into the workpiece 22, the head 96 of the screw passes through the resilient O-ring 94 and also enters into engagement with the workpiece 22. At approximately this time, the screw 20 resists further rotation and the predetermined torque level for the clutch 28 is exceeded. The clutch 28 operates in the manner described above so that the lever 76 is pivoted allowing the pin 62 to drop into the hole 80 on the lever.

The screwdriver then approaches the operating condition illustrated in FIG. 9 where air pressure is cut off both to the air motor 26 and the piston unit 54. The motor 26 ceases rotation of the screw 20. The piston unit 54 allows the tripper plate to again shift to the left so that the single screw 20′ drops downwardly through the funnel or chute 16 into the inlet chamber 98 of the holder.

The delay function provided by the sizing of the control valve, passage 50 and piston unit 56 causes the piston unit 56 to function only after the screw 20′ is in the holder. Thereafter, air pressure from the reservoir 36 acts on the piston unit 56 to shift the holder 24 down and away from the bit 18 into the position illustrated in FIG. 10. The subsequent fastener 20′ may then enter into alignment with the bit 18. Note FIG. 10 with the screw supported upon the resilient O-ring 94. Thereafter, air pressure is allowed to leak out of the piston unit 56 in a relatively short period of time so that the holder urges the subsequent fastner 20′ into engagement with the bit 18 generally during the time period required for the operator to lift the screw driver away from the workpiece.

It is again noted that as the operator lifts the screwdriver away from the workpiece, the clutch and bit are shifted relatively downwardly by the spring 64 and the lever 76 returns to its cocked position with the hole 80 out of alignment with the pin 62.

Thus, all components of the screwdriver automatically return to the initial position illustrated in FIG. 7. Accordingly, the screwdriver is automatically conditioned for push-to-start actuation when the operator again chooses to lower the screwdriver and the subsequent fastener 20′ into engagement with the workpiece.

Figure 11:
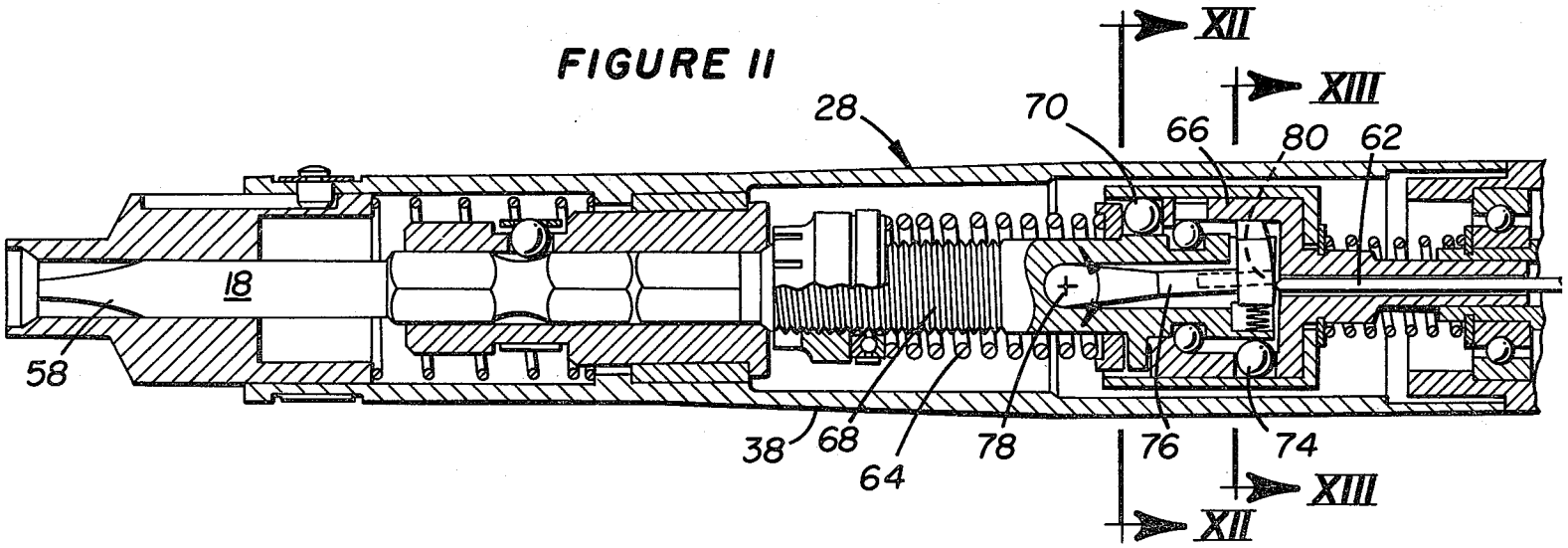
FIG. 11 is an axially sectioned fragmentary view of one embodiment of a torque responsive clutch arranged within the automatic screwdriver for interconnecting its motor means with the rotary drive means.

Another embodiment of a torque responsive clutch, similar to that illustrated in FIG. 11, is described below with reference to FIGS. 14, 15 and 15A. Components in those figures which correspond to components in FIGS. 11, 12, 12A, 13 and 13A are indicated by similar primed numerical labels. In addition, the normal and override conditions illustrated for the clutch in FIGS. 12 and 12A also apply to the torque responsive clutch of FIG. 14.

In FIG. 14, the pivoted lever 76 of FIG. 11 is replaced by a pivoted member 202 forming an axially extending opening 204 corresponding to the opening 80 in the lever 76. The member 202 is arranged within a counterbore 206 formed on the driven member 68 by a flange 208. The flange 208 is discontinuous to form an opening 210 for allowing the member 202 to interact with the detent balls 74′ in the same manner that the lever 76 interacts with the detent balls 74 in FIG. 11. A spring 212 is arranged between the member 202 and the flange 208 for urging the member 202 outwardly through the opening 210. The member 202 is secured to the driven membr 68 by a pivot 214 offset from and in parallel relation to the pin 62′ and the opening 204.

The member 202 functions in substantially the same manner as the lever 76 of FIG. 11 in order to permit shifting of the rod 62′ when the clutch is in an override condition (also see FIGS. 11, 12 and 12A). The embodiment of FIG. 14 differs from that of FIG. 11 primarily in the pivoted mode of operation for the lever 76 and the member 202. Whereas the lever 76 has a pivot access perpendicularly intersecting the axis of the clutch and the pin 62, the member 202 is adapted for travel about the pivot axis 214 which is parallel to and offset from the axis of the clutch and the pin 62′. Otherwise, the lever 76 and member 202 function in substantially the same manner for allowing the pin 62 or 62′ to shift leftwardly as seen in FIG. 11 or 14 respectively for terminating motor operation.

In addition, in each of the clutch embodiments, the lever 76 or member 202 is reset by relative axial movement of the driven member 68 or 68′ and the driving member 66 or 66′.

It will be apparent that various modifications and additions are possible within the scope of the present invention to those described above. Accordingly, the scope of the invention is defined only by the following appended claims.

What is claimed is:

1. An automatic push-to-start machine for automatically driving a threaded fastener into a work piece in response to engagement pressure between the threaded fastener and the work piece, comprising a housing, motor means, a torque responsive clutch, a rotary drive means interconnected with the motor means through the torque responsive clutch, a fastener holder arranged adjacent the rotary drive means, the rotary drive means and holder being movable relative to each other, a magazine mountable on the housing for providing a supply of fasteners, gate means for regulating passage of individual fasteners from the magazine to the holder, and control means operatively coupled with the motor means, the torque responsive clutch, the relatively movable combination of the rotary drive means and holder and the gate means, the control means including means for functioning automatically in response to push-to-start engagement of the fastener with the work piece for (a) initiating operation of the motor means through the torque responsive clutch and rotary drive means to rotate the fastener (b) terminating operation of the motor means when a predetermined torque level is sensed by the clutch, (c) causing a subsequent fastener to be released from the magazine, (d) shifting the holder and the rotary drive means relative to each other for allowing the subsequent fastener to enter into alignment with the rotary drive means, (e) returning the holder and rotary drive means to a position where the holder secures the fastener in engagement with the rotary drive means, and (f) thereafter returning the control means to the condition prior to step (a) whereby the machine is automatically conditioned for driving the subsequent fastener upon push-to-start actuation thereof.

2. The machine of claim 1 further comprising means for communicating a fluid under pressure to the machine, the control means comprising a valve, the motor means being fluid actuated and in communication with the fluid valve.

3. The machine of claim 2 further comprising first fluid actuated means operatively interconnected with the rotary drive means and holder for moving them relative to each other, the first fluid actuated means also being in effective communication with the valve.

4. The machine of claim 2 or 3 further comprising a second fluid actuated means in communication with the valve, the gate means being operatively responsive to the second fluid actuated means.

5. The machine of claim 3 further comprising means forming a fluid reservoir in communication with the valve, the valve including means for placing the reservoir in communication with the first fluid actuated means for shifting the holder and rotary drive means relative to each other for allowing a fastener to enter into alignment with the rotary drive means and thereafter allowing the holder and rotary drive means to return to a position with the holder securing the fastener in engagement with the rotary drive means.

6. The machine of claim 3 or 5 further comprising delay means for delaying operation of the first fluid actuated means until a subsequent fastener is available for entry into alignment with the rotary drive means.

7. The machine of claim 1 wherein the magazine includes an elongated chamber for containing the fasteners with their threaded shanks parallel to each other and the heads of successive fasteners opposite each other.

8. The machine of claim 7 further comprising a chute for receiving the individual fasteners from the gate means and directing them toward the holder, the chute including alignment means for engaging the heads of successive fasteners in order to assure proper alignment of the fasteners with the holder and rotary drive means.

9. The machine of claim 7 wherein the elongated chamber formed by the cartridge housing includes a central channel for containing the fasteners with their threaded shanks parallel to each other and enlarged channels at either side of the central channel for containing the heads of successive fasteners opposite each other.

10. The machine of claim 1, 7 or 9 wherein the fasteners have heads formed with a kerf, the rotary drive means including a bit for engaging the kerf of each fastener.

11. The machine of claim 1 wherein the holder is formed with an axially extending passage for receiving a fastener in alignment with the rotary drive means and an intersecting side passage for receiving successive fasteners from the gate means.

12. The machine of claim 11 further comprising a chute for receiving the individual fasteners from the gate means and directing them toward the holder, the chute including alignment means for engaging the heads of successive fasteners in order to assure proper alignment of the fasteners with the holder and rotary drive means.

13. The machine of claim 1 or 11 wherein the holder includes resilient means for normally securing the fastener in engagement with the rotary drive means and yieldably allowing passage of the fastener.

14. The machine of claim 1 wherein the torque responsive clutch includes a rotary driving member and a rotary driven member, the clutch being operable in a drive condition with the driving and driven members rotating together and in an override condition with the drive member rotating relative to the driven member, and further comprising a pin movable along the axis of the clutch for terminating operation of the motor means and a pivoted member and cam means arranged for interaction in the override condition of the clutch to permit axial movement of the pin for terminating operation of the motor means.

15. The machine of claim 14 wherein a pivot axis for the pivoted member perpendicularly intersects the axis of the clutch, the pivoted member forming an opening for permitting axial movement of the pin when the pivoted member intersects with the cam means.

16. The machine of claim 15 wherein the pivoted member is pivotably mounted on the driven member the cam means being carried for rotation on the driving member.

17. The machine of claim 14 wherein a pivot axis for the pivoted member is arranged in parallel offset relation to the clutch axis, the pivoted member forming an opening for permitting axial movement of the pin when the pivoted member interacts with the cam means.

18. The machine of claim 17 wherein the pivoted member is pivotably mounted on the driven member, the cam means being carried for rotation on the driving member.

19. A pneumatically powered machine for applying a threaded fastener to a workpiece comprising a housing, a fluid actuated motor means, a torque-responsive clutch means, a rotary drive means interconnected with the motor means through the torque responsive clutch means, a fastener holder arranged adjacent the rotary drive means in relatively movable relation thereto, means for providing a supply of successive fasteners, means for communicating a fluid under pressure, means forming a fluid reservoir, fluid valve means operable for communicating fluid under pressure to the motor means and to the reservoir, the valve means being responsive to the clutch means for terminating operation of the motor means, and means responsive to the valve means for placing the reservoir in effective communication with the relatively movable combination of the holder and rotary drive means to shift them relative to each other for allowing a subsequent fastener to enter into alignment with the rotary drive means and thereafter allowing the holder and rotary drive means to return to a position where the holder secures the subsequent fastener in engagement with the rotary drive means.

20. The machine of claim 19 further comprising a first fluid actuated means operatively interconnected with the relatively movable holder and rotary drive means, the first fluid actuated means being in communication with the fluid valve means.

21. The machine of claim 20 further comprising a movable gate means for regulating passage of individual fasteners from the magazine to the holder and a second fluid actuated means in communication with the valve, the gate means being operatively responsive to the second fluid actuated means.

22. The machine of claim 20 or 21 further comprising delay means for delaying operation of the first fluid actuated means until a subsequent fastener is available for entry into alignment with the rotary drive means.

23. The machine of claim 21 further comprising a magazine mountable on the housing for providing a supply of fasteners to the gate means.

24. The machine of claim 23 wherein the magazine includes an elongated chamber configured for containing successive fasteners in opposed relation to each other and further comprising a chute for receiving the individual fasteners from the gate means and directing them toward the holder, the chute including alignment means for engaging the heads of successive fasteners in order to assure proper alignment of the fasteners with the holder and rotary drive means.

25. The machine of claim 19 wherein the holder is formed with an axially extending passage for receiving a fastener in alignment with the rotary drive means and an intersecting side passage for receiving successive fasteners from the gate means.

26. The machine of claim 25 further comprising a chute for receiving the individual fasteners from the gate means and directing them toward the holder, the chute including alignment means for engaging the heads of successive fasteners in order to assure proper alignment of the fasteners with the holder and rotary drive means.

27. The machine of claim 19 or 25 wherein the holder includes resilient means for normally securing the fastener in engagement with the rotary drive means and yieldably allowing passage of the fastener.

28. The machine of claim 19 wherein the torque responsive clutch includes a rotary driving member and a rotary driven member, the clutch being operable in a drive condition with the driving and driven members rotating together and in an override condition with the drive member rotating relative to the driven member, and further comprising a pin movable along the axis of the clutch for terminating operation of the motor means and a pivoted member and cam means arranged for interaction in the override condition of the clutch to permit axial movement of the pin for terminating operation of the motor means,

29. The machine of claim 28 wherein a pivot axis for the pivoted member perpenducularly intersects the axis of the clutch, the pivoted member forming an opening for permitting axial movement of the pin when the pivoted member interacts with the cam means.

30. The machine of claim 29 wherein the pivoted member is pivotably mounted on the driven member the cam means being carried for totation on the driving member.

31. The machine of claim 28 wherein a pivot axis for the pivoted member is arranged in parallel offset relation to the clutch axis, the pivoted member forming an opening for permitting axial movement of the pin when the pivoted member interacts with the cam means.

32. The machine of claim 31 wherein the pivoted member is pivotably mounted on the driven member the cam means being carried for rotation on the driving member.

33. In a powered machine of a type adapted for driving fasteners having a threaded shank at one end and an enlarged head at the other end, the machine including a housing, motor means, a rotary drive means operable by the motor means for rotating one of the fasteners and a holder for securing successive fasteners in engagement with the rotary drive means, the improvement comprising an elongated magazine mountable upon the housing for providing a supply of fasteners, the magazine including an elongated chamber for containing the fasteners with their threaded shanks parallel to each other and the heads of successive fasteners opposite each other, gate means operable for sequentially releasing individual fasteners from the magazine, and a chute for directing the individual fasteners from the gate means toward the holder, the chute including alignment means for engaging the heads of successive fasteners in order to assure proper alignment of the fasteners with the holder and rotary drive means.

34. The machine of claim 33 wherein the gate means and chute are replaceable upon the machine in order to adapt the machine for fasteners of different size.

35. The machine of claim 33 or 34 wherein the elongated chamber formed by the cartridge housing includes a central channel for containing the fasteners with their threaded shanks parallel to each other and enlarged to channels at either side of the central channel for containing the heads of successive fasteners opposite each other.

36. The machine of claim 33 wherein the fasteners have heads formed with a kerf, the rotary drive means including a bit for engaging the kerf of each fastener.

37. The machine of claim 33 wherein the magazine is mountable generally vertically on the machine for gravity feed of the fasteners to the gate means.

38. A magazine adapted for mounting on a powered machine of a type for driving fasteners having a threaded shank at one end and an enlarged head at the other end, the magazine comprising a housing forming an elongated chamber including a central channel for containing the fasteners with their threaded shanks parallel to each other and enlarged channels at either side of the central channel for containing the heads of successive fasteners opposite each other, the housing also forming an opening at one end of the elongated chamber for allowing the oppositely arranged fasteners to pass successively from the chamber, the opening further being arranged for directing the successive fasteners into a suitable receiving means when the magazine is mounted on the fastener driving machine.

39. An automatic machine for driving a threaded fastener into engagement with a workpiece, comprising a housing, motor means, a torque responsive clutch, and a rotary drive means interconnected with the motor means through the torque responsive clutch, the torque responsive clutch including a rotary driving member and a rotary driven member, the clutch being operable in a drive condition with the driving and driven members rotating together and in an override condition with the drive member rotating relative to the driven member, and further comprising a pin movable along the axis of the clutch for terminating operation of the motor means and a pivoted member and cam means arranged for interaction in the override condition of the clutch to permit axial movement of the pin for terminating operation of the motor means.

40. The machine of claim 39, wherein a pivot axis for the pivoted member perpendicularly intersects the axis of the clutch, the pivoted member forming an opening for permitting axial movement of the pin when the pivoted member intersects with the cam means.

41. The machine of claim 40 wherein the pivoted member is pivotably mounted on the driven member, the cam means being carried for rotation with the driving member.

42. The machine of claim 39 wherein a pivot axis for the pivoted member is arranged in parallel offset relation to the clutch axis, the pivoted member forming an opening for permitting axial movement of the pin when the pivoted member interacts with the cam means.

43. The machine of claim 42 wherein the pivoted member is pivotably mounted on the driven member, the cam means being carried for rotation with the driving member

* * * * *